US010614980B2

(12) United States Patent
Newinger

(10) Patent No.: US 10,614,980 B2
(45) Date of Patent: Apr. 7, 2020

(54) VACUUM BOTTLE FOR ELECTRICAL SWITCHING DEVICE

(71) Applicant: Schneider Electric Industries SAS, Rueil-Malmaison (FR)

(72) Inventor: Pierre Newinger, St Joseph de Riviere (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 16/180,334

(22) Filed: Nov. 5, 2018

(65) Prior Publication Data

US 2019/0172665 A1 Jun. 6, 2019

(30) Foreign Application Priority Data

Dec. 4, 2017 (FR) ..... 17 61585

(51) Int. Cl.
*H01H 33/12* (2006.01)
*H01H 33/66* (2006.01)
(Continued)

(52) U.S. Cl.
CPC ..... *H01H 33/125* (2013.01); *H01H 33/664* (2013.01); *H01H 33/6606* (2013.01); *H01H 33/6646* (2013.01); *H01H 33/66207* (2013.01); *H01H 33/66238* (2013.01); *H01H 2033/66215* (2013.01); *H01H 2033/66223* (2013.01); *H01H 2203/024* (2013.01); *H01H 2207/026* (2013.01); *H01H 2223/024* (2013.01)

(58) Field of Classification Search
CPC ..... H01H 33/125; H01H 33/66207; H01H 33/664; H01H 33/6646; H01H 33/66; H01H 33/662; H01H 2033/66215; H01H 2033/66223; H01H 11/04
USPC ... 218/10, 11, 121, 123, 125, 127, 139, 146, 218/155
See application file for complete search history.

(56) References Cited

U.S. PATENT DOCUMENTS 4,492,837 A * 1/1985 Crouch ..... H01H 33/66 200/83 D
5,168,139 A 12/1992 Bettge et al.
7,781,694 B2 * 8/2010 Stoving ..... H01H 33/66261 218/136

FOREIGN PATENT DOCUMENTS

DE 38 03 778 A1 8/1989
DE 40 11 194 A1 8/1990
(Continued)

OTHER PUBLICATIONS

Translation of DE4011194 (original document published Aug. 2, 1990) (Year: 1990).*
(Continued)

*Primary Examiner* — William A Bolton
(74) *Attorney, Agent, or Firm* — Oblon, McClelland, Maier & Neustadt, L.L.P.

(57) ABSTRACT

A vacuum bottle that is intended for an electrical switching device includes a cylindrical body of insulating material closed at each end respectively by a first metal cover and a second metal cover, and a mobile electrode that passes through the first cover and that cooperates with a fixed electrode between a closed position in which the two electrodes are in contact with each other and an open position in which the two electrodes are separated. The bottle includes the second cover corresponding to the fixed electrode of the vacuum bottle.

7 Claims, 2 Drawing Sheets

Figure 1:
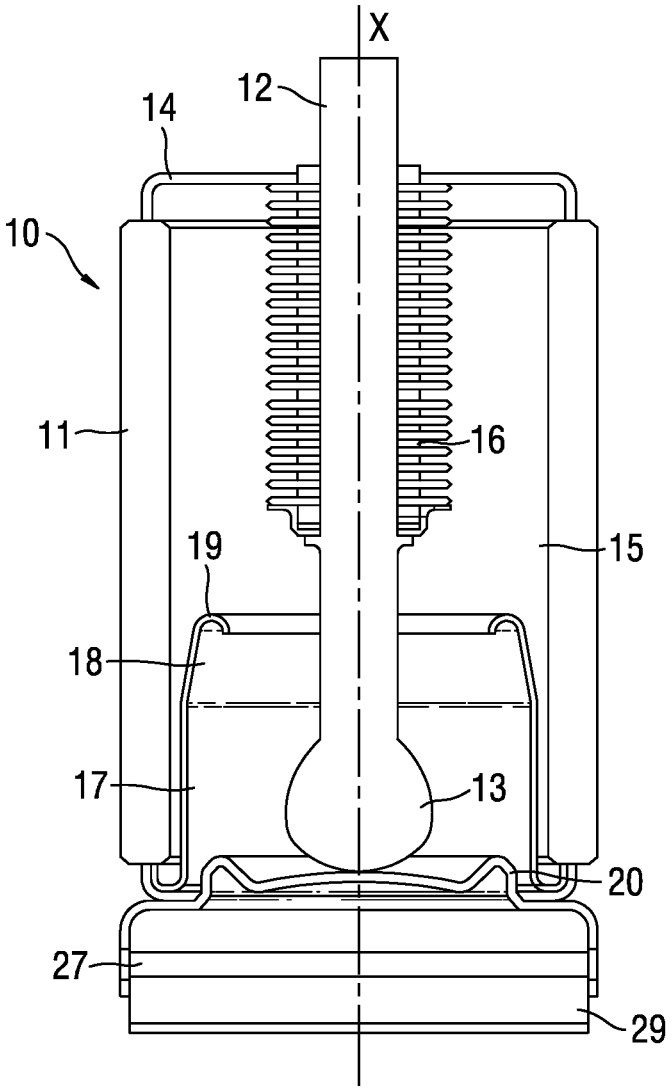

(51) Int. Cl.
*H01H 33/662* (2006.01)
*H01H 33/664* (2006.01)

(56) References Cited

FOREIGN PATENT DOCUMENTS

| | | |
|---|---|---|
| DE | 44 01 356 A1 | 7/1995 |
| DE | 199 33 111 A1 | 1/2001 |
| WO | WO 93/11552 A1 | 6/1993 |

OTHER PUBLICATIONS

French Preliminary Search Report dated Jul. 6, 2018 in French Application 17 61585 filed on Dec. 4, 2017 (with English Translation of Categories of Cited Documents and Written Opinion).

* cited by examiner

VACUUM BOTTLE FOR ELECTRICAL SWITCHING DEVICE

TECHNICAL FIELD OF THE INVENTION

The present invention relates to a vacuum bottle intended to ensure the switching of an electric circuit in an electrical switching device operating at medium voltage or high voltage, that is to say, operating at a voltage higher than 1000 V.

The invention also relates to an electrical switching device including such a vacuum bottle for at least one of its phases. In the present document, the term electrical switching device equally comprises several types of electrical devices such as a switch, a circuit breaker, a contactor, a fuse switch, a disconnector, a recloser, etc.

PRIOR ART

A medium voltage or high voltage electrical switching device of the type described for example in the document EP2182536, which is incorporated by reference in the present document, includes a vacuum bottle that is placed, not in the main circuit of the main switch of a phase of the electrical switching device, but in a parallel derivation of this main circuit. In normal functioning when the main switch is closed, no current passes in the derivation containing the vacuum bottle. The latter is only solicited during an operation of opening the main circuit by means of a mechanism for opening the main switch, which allows the current to be progressively switched from the main circuit to the derivation, so as to open the main switch while the current circulates entirely in the vacuum bottle. It is only once the main switch is open that the vacuum bottle in turn changes from the closed position to the open position by means of the opening mechanism. The appearance of a switching electric arc at the main switch during the opening operation is thus avoided.

Thanks to this architecture, a current only passes through the vacuum bottle during the opening phase of the main phase circuit and not when the main switch is closed. Furthermore, the bottle is not solicited during a closing operation of the main circuit, neither does it have to withstand a potential short-circuit current. It must just be capable of withstanding a transient recovery voltage (TRV) after interrupting the current in the main circuit.

The result is that, in such an architecture, the vacuum bottle can advantageously be simplified and designed in a much smaller size compared with a conventional architecture in which the vacuum bottle is placed for example in the main circuit of the electrical switching device. As an example, such a vacuum bottle could have a transverse diameter of the order of approximately 50 mm for a voltage of 24 kV and the opening distance between the electrodes would be of the order of 7 to 12 mm. However, the reduction in size of the vacuum bottle potentially causes greater dielectric constraints than on a larger size of vacuum bottle.

Furthermore, the documents DE4011194A1, WO9311552A1, DE19933111A1 and DE4401356A1 describe different architectures of vacuum bottles.

The aim of the invention is therefore to design a smaller size of vacuum bottle that is capable of withstanding the dielectric constraints due to the reduction of its dimensions. The aim of the invention is also to design a vacuum bottle that is as simple and economical as possible.

DESCRIPTION OF THE INVENTION

These aims are achieved by a vacuum bottle intended for an electrical switching device, comprising a cylindrical body of insulating material closed at each end respectively by a first metal cover and a second metal cover, the vacuum bottle comprising a mobile electrode that passes through the first cover and that cooperates with a fixed electrode between a closed position in which the two electrodes are in contact with each other and an open position in which the two electrodes are separated. According to the invention, the second cover corresponds to the fixed electrode of the vacuum bottle and the second cover is extended by projections intended to be connected directly with a busbar belonging to a pole of the electrical switching device.

According to one characteristic, the second cover includes a central fixed contact zone having a shape of a spherical cap turned towards the inside of the vacuum bottle. According to another characteristic, the mobile electrode includes a mobile contact zone of rounded shape situated facing the fixed contact zone. The fixed contact zone has a bend radius greater than that of the mobile contact zone.

According to another characteristic, the second cover is made of stainless steel. According to another characteristic, the vacuum bottle includes a metal fastening strap between the cylindrical tube and the second cover.

According to another characteristic, the second cover also includes a concentric recess, turned towards the inside of the vacuum bottle and placed between the central contact zone and an outside zone for fastening the cover to the cylindrical tube.

According to another characteristic, the vacuum bottle comprises a metal screen of circular transverse section surrounding the mobile contact zone and which includes one end fastened to the second cover and one opposite end that is free. The free end of the screen presents a bend oriented towards the inside of the vacuum bottle.

The invention also relates to an electrical switching device including such a vacuum bottle for at least one of its phases, the vacuum bottle being placed as derivation of a main circuit of at least one phase of the electrical switching device.

DETAILED DESCRIPTION

Figure 2:
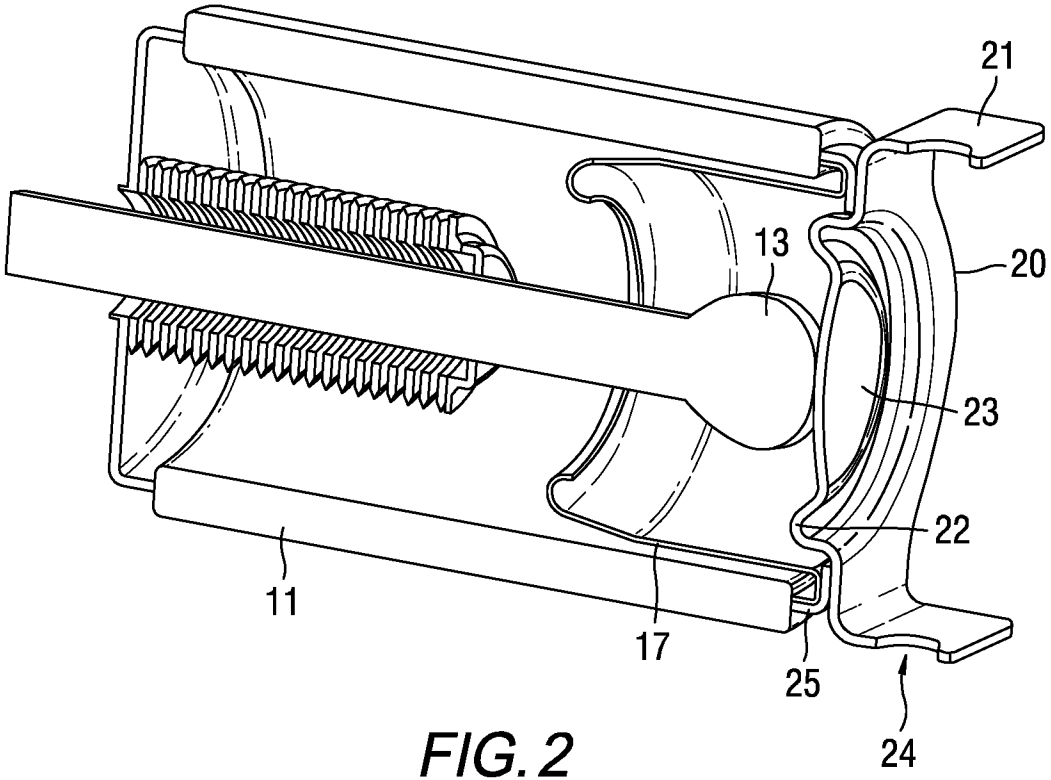

Other characteristics will emerge in the detailed description that follows, made in the light of the attached drawings, in which:

FIG. 1 shows a simplified view of an embodiment of a vacuum bottle in closed position according to the invention, along a section in a longitudinal plane, FIG. 2 shows a section in perspective of this vacuum bottle.

With reference to FIG. 1, a vacuum bottle 10 includes a body 11 with a substantially cylindrical tube shape of insulating material, preferably ceramic, whose two ends are closed respectively by a first metal cover 14 and a second metal cover 20. The tube 11 and the covers 14, 20 delimit an inside switching chamber 15 in which it is possible to make a vacuum.

The vacuum bottle 10 includes a conducting electrode 12 (also called conducting stem) that passes through the first cover 14 and is terminated in the switching chamber 15 by a first contact zone 13. This electrode 12 is mobile along a longitudinal axis X of the vacuum bottle 10 and is driven in a known manner by a mechanism not illustrated in the figures. A sealing bellows 16 partially surrounds the mobile electrode 12 to allow longitudinal movement of the electrode 12 while preserving the sealing of the switching chamber 15 relative to the outside.

A vacuum bottle usually also includes in the switching chamber 15 a fixed electrode including a fixed contact zone, which is disposed such that the mobile electrode 12 can move between a position called closed in which the fixed electrode and the mobile electrode are in contact with each other via their respective contact zones so that a current can pass through the vacuum bottle 10 and a position called open in which the two electrodes are separated.

According to the invention, the second cover 20 corresponds to the fixed electrode of the vacuum bottle 10. It is the second cover 20 that acts as fixed electrode and that is therefore in direct contact with the mobile electrode 12 when the vacuum bottle is in closed position. The second cover 20 thus advantageously fulfils a dual function: ensuring sealing of one of the two ends of the vacuum bottle 10 and ensuring electrical contact with the mobile electrode 12. Thanks to the invention, the number of parts involved in manufacturing the vacuum bottle 10 is thus reduced, as there is no need for a fixed electrode as such. This solution is therefore simpler and more economical.

During the opening phase, the appearance of a transient recovery voltage (TRV) causes a high electrical field in certain regions of a vacuum bottle that includes ridges. In the present case, this problem is compounded because of the small dimensions of the vacuum bottle. This is why the mobile contact zone 13 of the mobile electrode 12 is not flat as in the usual solutions, but is of rounded shape, so as to avoid excessively pronounced angles and ridges. This solution makes it possible to avoid peaks and gives better distribution of the electrical field over a larger part of the mobile contact zone 13. The mobile contact zone 13 presents for example a dome that can be partially spherical or elliptical, as shown on the figures. Furthermore, the transverse diameter of the mobile contact zone 13, that is to say, the diameter of a transverse section along a plane perpendicular to the longitudinal axis X is globally greater than the transverse diameter of the rest of the mobile electrode 12, which results in the mobile contact zone 13 forming a sort of excrescence (or a ball) at the end of the mobile electrode 12.

Likewise, the second cover 20 comprises a contact zone 23, called fixed contact zone, that can be substantially circular and that occupies the central part of the second cover 20 around the longitudinal axis X. This fixed contact zone 23 is situated facing the mobile contact zone 13 of the mobile electrode 12 so as to be able to open and close the vacuum bottle 10. According to one embodiment, the fixed contact zone 23 presents a rounded cap shape turned towards the inside of the vacuum bottle 10, for example, a spherical cap shape whose curve radius, that is to say the radius of a longitudinal section along a plane passing through the longitudinal axis X is significant and greater than the curve radius of the mobile contact zone 13 facing it, which allows better dielectric strength. As an example, it is possible to envisage a curve radius of approximately 50 mm for the cap of the fixed contact zone 23 and approximately 15 mm for the end of the mobile contact zone 13.

In order to reduce the electrical field as much as possible, more sophisticated rounded shapes are possible for the contact zones 13 and 23, for example by associating several curve radii (Rogowski, Borda type profiles) as indicated in the figures for the mobile contact zone 13.

The fact of having the two contact zones 13, 23 that are not flat theoretically causes a reduction of the surfaces that are in contact and thus increases the contact resistance when the bottle 10 is in closed position. However, this is acceptable in the present case, as the vacuum bottle is placed in a derivation circuit and not in a main circuit of the electrical switching device and it is therefore only used during the opening operations, as indicated previously. It must therefore only withstand the currents for a much shorter time.

According to an embodiment, the second cover 20 is made of stainless steel, which is a conducting metal, economical and which moreover presents a shock resistance that is greater than that of copper and sufficient to be well able to absorb the shocks on contacts with the mobile electrode 12. The mobile electrode 12 can also be made of stainless steel. The second cover 20 can furthermore present particular shapes, such as a reinforcement 22 turned towards the inside of the vacuum bottle 10 and for example, substantially V shaped as indicated in the figures. This reinforcement 22 is concentric, placed between the central fixed contact zone 23 around the longitudinal axis X and the outside attachment zone of the cover 20 to the cylindrical tube 11. It very easily makes it possible successfully to centre the cover 20 relative to the cylindrical tube 11 thanks to the toroidal fastening strap 25 (see next paragraph) and better to resist the pressure difference between the vacuum of the inside of the bottle 10 and the pressure outside the bottle 10 in the tank of the electrical switching device.

However, it is difficult to braze the cover 20 in stainless steel directly onto the ceramic of the cylindrical tube 11, because, when cooling, the stresses at the brazing joint would be too significant and could cause cracking of the ceramic of the tube. In order to avoid this problem and to improve the attachment of the second cover 20 to the cylindrical tube 11, the vacuum bottle 10 can include a fastening strap 25 that is placed between one end of the cylinder 11 and the second cover 20. This fastening strap 25 has a torus shape and is preferably made of copper, which makes it possible on one hand to attach it by brazing to the tube 11 and on the other to braze it easily against the outer perimeter of the second cover 20 without inducing stress, because of the ductility of the copper after passing at high temperature in the furnace. As indicated above, the fastening strap 25 also makes it possible successfully to centre the cover 20 thanks to the recess 22, which is disposed to be positioned just inside the fastening strap 25.

The vacuum bottle 10 also comprises a protective metal screen 17, one of whose ends is fastened to the second cover 20. This protective screen 17 has a circular transverse section and extends along the longitudinal axis X so as to surround the mobile contact zone 13. It comprises on one side a first end that is therefore attached by brazing to the strap 25 and to the tube 11, and on the opposite side, an end that is free. Other secondary screens not illustrated can also be envisaged, such as for example a screen protecting the bellows 16.

Furthermore, in order to improve the distribution of the electric field, the invention also provides that the free end of the screen 17 is terminated by a bend 19, which avoids having a ridge at this free end. This bend 19 is preferably oriented towards the inside of the bottle.

The second cover 20 is extended on two opposite sides by projections 21 that are intended to be in direct contact with a busbar 29 belonging to one pole of the electrical switching device in which the vacuum bottle 10 is installed, in particular to the derivation circuit of one pole if the vacuum bottle is placed in a parallel derivation of the main circuit of the electrical switching device. In the embodiment described, the projections 21 are perpendicular to the cover 20 and the metal bar 29 is fastened to the projections 21 of the second cover 20 for example thanks to a screw 27 passing through the bar 29 and inserted through two orifices 24 of the projections 21. The vacuum bottle 10 can therefore very easily be electrically connected as derivation of the main circuit of at least one of the phases of the electric switching device.

The invention claimed is:

1. A vacuum bottle intended for an electrical switching device, comprising a cylindrical body of insulating material closed at each end respectively by a first metal cover and a second metal cover, the vacuum bottle including a mobile electrode that passes through the first cover and that cooperates with a fixed electrode between a closed position in which the mobile electrode and the fixed electrode are in contact with each other and an open position in which the mobile electrode and the fixed electrode are separated, wherein the second cover corresponds to the fixed electrode of the vacuum bottle and includes projections intended to be connected directly with a busbar belonging to a pole of the electrical switching device, wherein the second cover includes a central fixed contact zone having a shape of a spherical cap turned towards an inside of the vacuum bottle, wherein the mobile electrode includes a mobile contact zone of rounded shape situated facing the fixed contact zone and wherein the fixed contact zone presents a curve radius greater than that of the mobile contact zone.

2. The vacuum bottle according to claim 1, wherein the second cover also comprises a concentric recess, turned towards the inside of the vacuum bottle and placed between the central contact zone and an outside zone for fastening the cover to the cylindrical body.

3. The vacuum bottle according to claim 2, wherein the vacuum bottle comprises a metal fastening strap between the cylindrical body and the second cover.

4. The vacuum bottle according to claim 3, wherein the fastening strap is made of copper and the second cover is made of stainless steel.

5. The vacuum bottle according to claim 1, wherein the vacuum bottle comprises a metal screen of circular transverse section surrounding the mobile contact zone and which includes one end fastened to the second cover and one opposite end that is free.

6. The vacuum bottle according to claim 5, wherein the free end of the screen presents a bend oriented towards the inside of the vacuum bottle.

7. An electrical switching device, comprising at least one vacuum bottle intended for the electrical switching device, including a cylindrical body of insulating material closed at each end respectively by a first metal cover and a second metal cover, the vacuum bottle including a mobile electrode that passes through the first cover and that cooperates with a fixed electrode between a closed position in which the mobile electrode and the fixed electrode are in contact with each other and an open position in which the mobile electrode and the fixed electrode are separated, wherein the second cover corresponds to the fixed electrode of the vacuum bottle and includes projections intended to be connected directly with a busbar belonging to a pole of the electrical switching device, wherein the second cover includes a central fixed contact zone having a shape of a spherical cap turned towards an inside of the vacuum bottle, wherein the mobile electrode includes a mobile contact zone of rounded shape situated facing the fixed contact zone and wherein the fixed contact zone presents a curve radius greater than that of the mobile contact zone, the vacuum bottle being placed as derivation of a main circuit of at least one phase of the electrical switching device.

* * * * *